US005199745A

United States Patent [19]

Balsamo

[11] Patent Number: 5,199,745

[45] Date of Patent: Apr. 6, 1993

[54] CONFETTI SURPRISE GREETING CARD

[76] Inventor: Lawrence J. Balsamo, 539 Yosemite Ct., Roselle, Ill. 60172

[21] Appl. No.: 864,413

[22] Filed: Apr. 6, 1992

[51] Int. Cl.[5] ..... G09F 1/00

[52] U.S. Cl. ..... 283/117; 40/124.1; 446/475; 206/469

[58] Field of Search ..... 283/117, 1; 40/124.1; 446/475; 206/461, 462, 469

[56] References Cited

U.S. PATENT DOCUMENTS

| | | | |
|---|---|---|---|
| 1,090,778 | 3/1914 | Clark | 446/475 |
| 1,423,122 | 7/1922 | Kyriazopoulos | 446/475 |
| 4,484,768 | 11/1984 | Norfleet | 446/147 X |
| 4,787,160 | 11/1988 | Balsamo | 446/475 X |
| 4,951,404 | 8/1990 | Lithwick | 40/124.1 |
| 4,951,969 | 8/1990 | Epstein et al. | 40/124.1 |

*Primary Examiner*—Mark Rosenbaum
*Assistant Examiner*—William Freidie, Jr.
*Attorney, Agent, or Firm*—Dillis V. Allen

[57] ABSTRACT

A greeting card with a rupturable tissue paper confetti package that spews confetti when opened by the surprised recipient. The confetti package is mounted on the inside of one of the card leaves and a water soluble transparent adhesive aligned on the other leaf is activated by moistening and then pressing it into bonded contact with the confetti package. Giver instructions are optimally positioned underneath the transparent adhesive.

9 Claims, 2 Drawing Sheets

FIG. 1
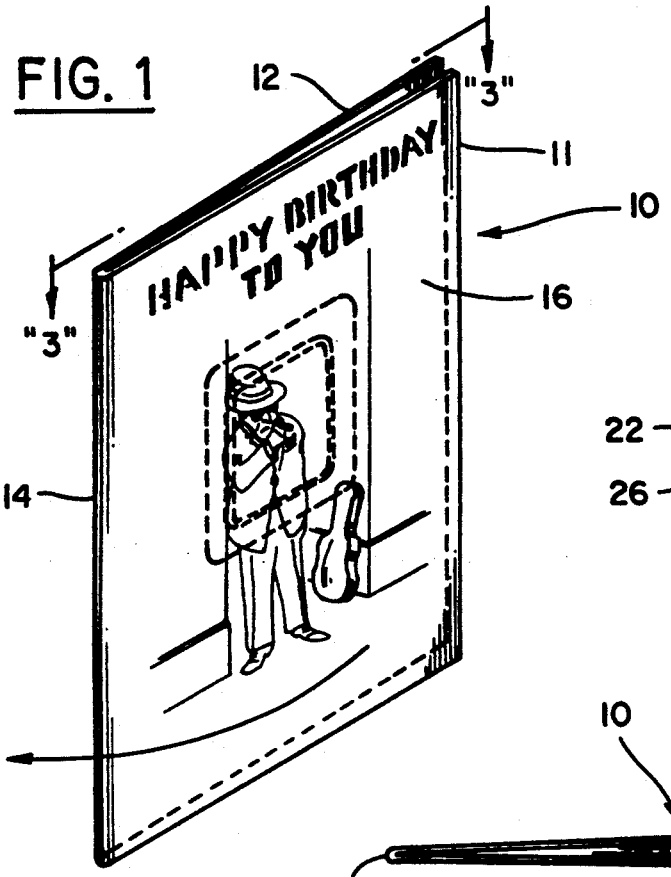
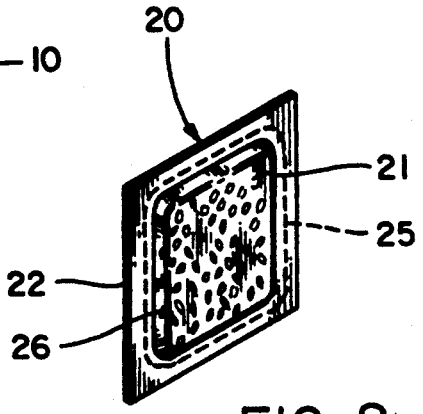
FIG. 2
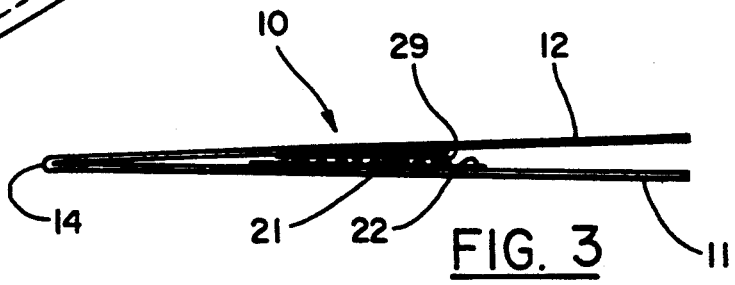
FIG. 3
FIG. 4
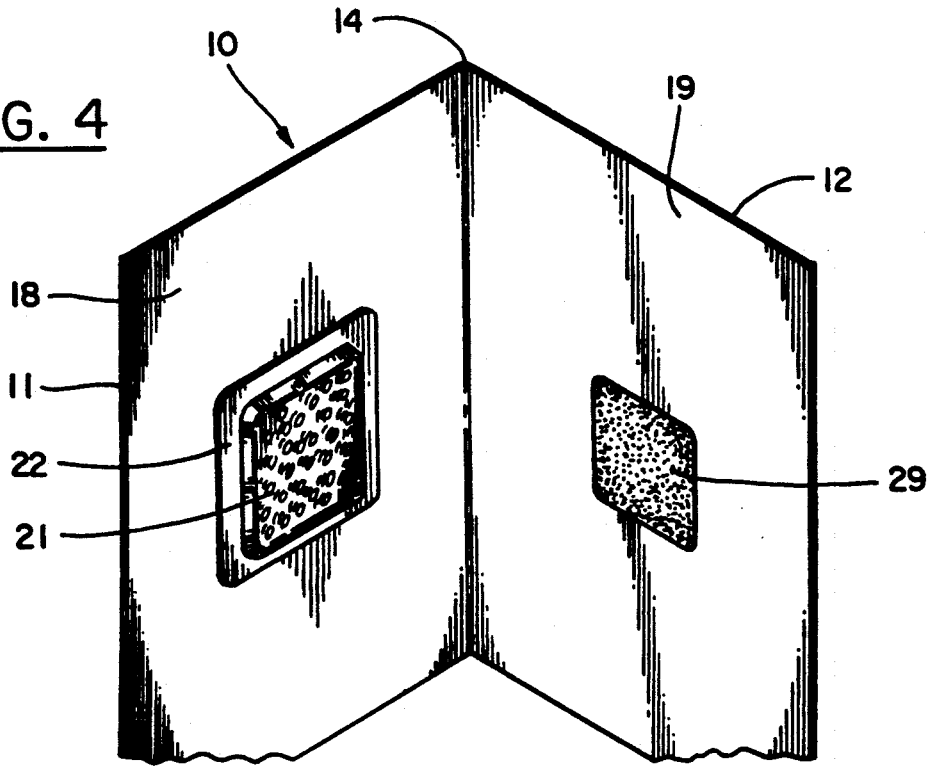

CONFETTI SURPRISE GREETING CARD

RELATED APPLICATIONS

This application is related to the co-pending reissue application of this inventor, Lawrence J. Balsamo, entitled GREETING CARD CONFETTI DELIVERY SYSTEM U.S. Ser. No. 619,746 filed Nov. 28, 1990, a reissue application based upon U.S. Pat. No. 4,787,160.

BACKGROUND OF THE INVENTION

Greeting cards with surprise messages have for many decades been extremely popular and of course the great majority of these surprise messages take the form of the written word.

There is another category of surprise message cards that instead of providing humor with the written word provide instead amusement by some physical movement such as card portions that move outwardly toward the receiver when opened.

Another form of surprise movement activated upon opening by the card receiver is disclosed in my co-pending reissue application U.S. Ser. No. 619,746 based upon my U.S. Pat. No. 4,787,160. In that application and the earlier patent a greeting card is shown with a rupturable confetti package activated by the giver so that when opened by the receiver spews confetti about providing the receiver not only with surprise but with harmless amusement.

In my prior card, the confetti packet consisted of a single relatively heavy cup-shaped plastic sheet with a bubble in its central area that was adhered to the inside of one of the card leaves. While this card achieved a significant degree of commercial success, the relatively heavy plastic bubble was difficult to fracture by the adhesive and therefore required a contact mastic adhesive, of the type manufactured by 3-M Corporation of Minneapolis, Minn. This type of contact adhesive is difficult to apply in the manufacturing process and requires a protective layer to prevent its premature adherence to the other side of the card before desired by the giver.

The plastic confetti package, the contact adhesive and the protective layer increase the cost of my prior confetti card and it is a primary object of the present invention to provide a lower cost surprise confetti greeting card that functions in an improved manner and is easier to manufacture.

SUMMARY OF THE PRESENT INVENTION

In accordance with the present invention a surprise greeting card is provided with a rupturable confetti package that spews confetti about when opened by the unsuspecting recipient. The confetti package is mounted on the inside of one of the card leaves and a water soluble transparent adhesive aligned on the other leaf is activated by moistening. Giver instructions are optimally positioned under the transparent adhesive.

Instead of housing the confetti in plastic containers as in my prior confetti card, the present confetti package is constructed of a tissue paper envelope bonded to one of the leaf inside surfaces with a surrounding adhesive ring. This produces a much more easily frangible package that enables it to be ruptured by a water soluble adhesive on the other leaf rather than the more costly contact adhesive embodied in the card shown in my above-described reissue application. The use of a water soluble adhesive eliminates the need for the adhesive protective layer required in my earlier confetti card.

The use of a water soluble adhesive and particularly a transparent adhesive permits the giver instructions relating to moistening the adhesive to be printed directly on the surface of the leaf in the area where the adhesive is applied thereover. Thus it can be printed at the same time as the other messages on the card instead of requiring a separate printing step formerly required on the protective layer for the contact adhesive in my earlier version.

Other objects and advantages of the present invention will appear more clearly from the following detailed description.

BRIEF DESCRIPTION OF THE DRAWINGS

FIG. 1 is a perspective view of the present greeting card with the confetti package shown in dotted lines;

FIG. 2 is a perspective sub-assembly of the confetti package;

FIG. 3 is a top view of the closed and activated greeting card according to the present invention taken generally along line 3—3 of FIG. 1;

FIG. 4 is a fragmentary perspective of the greeting card according to the present invention in an open position prior to adhesive moistening and activation;

DETAILED DESCRIPTION OF THE PREFERRED EMBODIMENT

Figure 5:
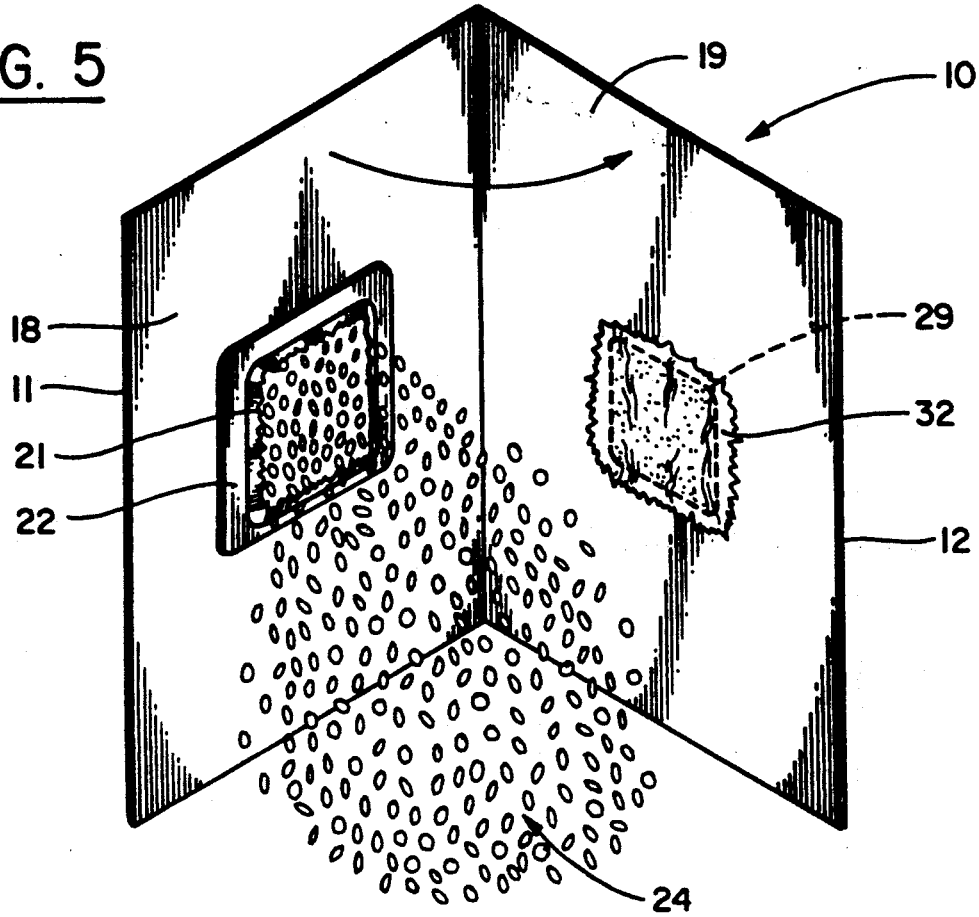
FIG. 5 is a perspective view similar to FIG. 4 after the card has been opened by the receiver spewing confetti.

Referring to the drawings and particularly FIGS. 1 to 4, a greeting card 10 is illustrated according to the present invention and is seen to be constructed basically of a single sheet of paper folded over to form identically sized first and second leaves 11 and 12 folded along a transverse fold line 14. The outer side 16 of the leaf 11 is the cover side with the initial message the receiver views prior to opening the card. The leaves 11 and 12 as seen in FIG. 4 have inwardly facing sides 18 and 19 that carry humorous messages and the giver's signature but printing has been eliminated in the drawings for simplicity except of course for the moistening instructions shown in FIG. 6.

As seen in FIGS. 2, 3, 4 and 6, a confetti package assembly 20 is provided consisting of a tissue paper envelope 21 fastened to leaf side 18 by a surrounding ring 22 with adhesive on its rear side.

The tissue paper envelope is itself a subassembly and has forward and back sides completely enclosing confetti 24 therein so that it can be manufactured as a separate unit. The tissue paper is on the order of 0.001 inches in thickness, approximately the same as a single ply household tissue paper, providing a much more easily frangible package than found in my prior confetti package. The necessary stability for the package is provided by the significantly heavier construction of ring 22 which is a paper sheet on the order of 0.003 to 0.005 inches in thickness having an adhesive backing. Note that the outside dimension of envelope 21 noted by dotted line 25 in FIG. 2 is greater than the cross dimensions of aperture 26 of ring 22.

The opposite leaf side 19 as seen in FIG. 3, carries a water soluble adhesive 29 of the type commonly found on mailing envelopes. Adhesive 29 is rectangular in configuration and aligned with and somewhat smaller than the exposed portion of the confetti envelope 21 when the card is closed as shown in FIG. 3. Because the adhesive 29 is water soluble and activated by moistening, there is no need for any protective covering as required in my prior card.

Figure 6:
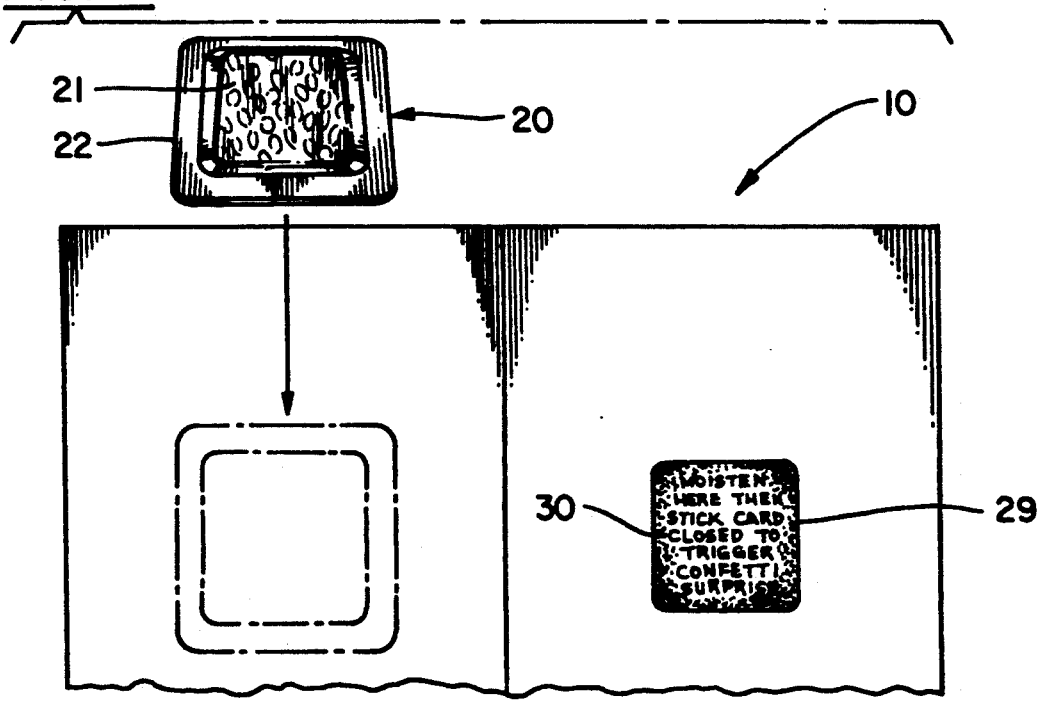
FIG. 6 is a fragmentary top view of the card according to the present invention with the confetti package exploded.

As seen more clearly in FIG. 6, a moistening instruction and activation message 30 for the giver is printed underneath, and of course prior to application of the adhesive 29, on leaf side 19. Because the message is printed directly on the card, it can be printed at the same time as the other messages on the inward card sides 18 and 19 so that additional printing costs previously required on adhesive protective layers is eliminated.

It is important to note that the location of the moistening message 30 directly underneath the adhesive, which is transparent, directs the giver to the exact area that needs to be moistened. That is, the adhesive 29 because it is transparent and very thin, may easily go unnoticed by the giver unless highlighted in some fashion. This provides an optimal location and is only possible because the adhesive is as noted substantially transparent.

In use, the giver after purchasing the card ascribes his or her own message to the recipient on one of the sides 18 and 19, then following the instructions 30, moistens adhesive 29 and closes the card pressing the adhesive 29 against the easily frangible tissue paper envelope 21. When placed in an envelope by the giver, the adhesive 29 dries and bonds to the tissue paper envelope 21 so that when opened by the receiver to the position shown in FIG. 6, a tissue paper fragment 32 is torn away from the envelope 21 spewing confetti 24 about surprising the unsuspected recipient.

It is also important to note that the combination of the water activated adhesive 29 and the tissue paper construction of envelope 21 produces a much larger package fragment 32 as shown in FIG. 5, yielding a much more dramatic expulsion and spewing of confetti 24 when it is opened than in my prior construction.

I claim:

1. A greeting card, comprising: first and second interconnected leaves foldable into engagement with one another each having an outwardly facing side and an inwardly facing side, the inwardly facing side of one leaf of the leaves having a rupturable package of confetti mounted thereon, said package having a center and a giver activated adhesive on the inwardly facing side of the other leaf aligned with and engageable with the center of the confetti package on the other leaf, said adhesive being a water soluble adhesive so it may be activated by moistening and when the leaves are closed the moistened adhesive adheres to the confetti package so when opened by the receiver fractures the package and expels the confetti, whereby the need for protective layers on the adhesive is eliminated.

2. A greeting card as defined in claim 1, wherein the confetti package has a thin tissue paper envelope easily broken by a water soluble adhesive.

3. A greeting card as defined in claim 2, including an adhesive ring surrounding the confetti package and adhering the package to the one leaf.

4. A greeting card as defined in claim 1, including a message area on the other leaf instructing the giver to moisten the adhesive and close the leaves, pressing the adhesive into contact with the confetti package.

5. A greeting card as defined in claim 1, including a message area on the other leaf under the adhesive instructing the giver to moisten the adhesive and close the card to activate rupture upon re-opening, said adhesive being transparent so the message area is visible to the giver prior to moistening.

6. A greeting card, comprising: first and second interconnected leaves foldable into engagement with one another each having an outwardly facing side and an inwardly facing side, the inwardly facing side of one leaf of the leaves having a rupturable package of confetti mounted thereon, said package having a center and a giver activated adhesive on the inwardly facing side of the other leaf aligned with and engageable with the center of the confetti package on the other leaf, said adhesive being a water soluble adhesive so it may be activated by moistening and when the leaves are closed the moistened adhesive adheres to the confetti package so when opened by the receiver fractures the package and expels the confetti, whereby the need for protective layers on the adhesive is eliminated; and a message area on the other leaf under the adhesive instructing the giver to moisten the adhesive and close the card to activate rupture upon re-opening, said adhesive being transparent so the message area is visible to the giver prior to moistening.

7. A greeting card as defined in claim 6, wherein the confetti package has a thin tissue paper envelope easily broken by water soluble adhesives, and an adhesive ring surrounding the confetti package and adhering the package to the one leaf.

8. A greeting card as defined in claim 6, wherein said message area on the other leaf instructs the giver to moisten the adhesive and close the leaves pressing the adhesive into contact with the confetti package.

9. A greeting card, comprising: first and second interconnected leaves foldable into engagement with one another each having an outwardly facing side and an inwardly facing side, the inwardly facing side of one leaf of the leaves having a rupturable package of confetti mounted thereon, said package having a center and a giver activated adhesive on the inwardly facing side of the other leaf aligned with and engageable with the center of the confetti package on the other leaf, said adhesive being a water soluble adhesive so it may be activated by moistening and when the leaves are closed the moistened adhesive adheres to the confetti package so when opened by the receiver fractures the package and expels the adhesive, whereby the need for protective layers on the adhesive is eliminated; a message area on the other leaf under adhesive instructing the giver to moisten the adhesive and close the card to activate rupture upon re-opening, said adhesive being transparent so the message area is visible to the giver prior to moistening, the confetti package having a thin tissue paper envelope easily broken by a water soluble adhesive, an adhesive ring surrounding the confetti package and adhering the package to the one leaf, and a message area on the other leaf instructing the giver to moisten the adhesive and close the leaves pressing the adhesive into contact with the confetti package.

* * * * *